US005193495A

United States Patent [19]

Wood, III

[11] Patent Number: 5,193,495

[45] Date of Patent: Mar. 16, 1993

[54] INTERNAL COMBUSTION ENGINE VALVE CONTROL DEVICE

[75] Inventor: Charles D. Wood, III, San Antonio, Tex.

[73] Assignee: Southwest Research Institute, San Antonio, Tex.

[21] Appl. No.: 730,613

[22] Filed: Jul. 16, 1991

[51] Int. Cl.[5] ..... F01L 9/02; F01L 1/34

[52] U.S. Cl. ..... 123/90.12; 123/90.14; 123/90.15

[58] Field of Search ..... 123/90.12, 90.13, 90.14, 123/90.15

[56] References Cited

U.S. PATENT DOCUMENTS

| | | | |
|---|---|---|---|
| 885,459 | 4/1908 | Engler | 123/90.12 |
| 3,257,999 | 6/1966 | Fiedler | 123/90.12 |
| 4,206,728 | 6/1980 | Trenne | 123/90.12 |
| 4,873,948 | 10/1989 | Richeson et al. | 123/90.14 |
| 4,889,085 | 12/1989 | Yagi et al. | 123/90.12 |
| 4,899,700 | 2/1990 | Richeson, Jr. et al. | 123/90.11 |
| 4,915,015 | 4/1990 | Richeson et al. | 123/90.14 |
| 5,022,358 | 6/1991 | Richeson | 123/90.12 |
| 5,058,538 | 10/1991 | Erickson et al. | 123/90.12 |

FOREIGN PATENT DOCUMENTS

| | | | |
|---|---|---|---|
| 169615 | 9/1985 | Japan | 123/90.12 |

*Primary Examiner*—E. Rollins Cross
*Assistant Examiner*—Weilun Lo
*Attorney, Agent, or Firm*—Baker & Botts

[57] ABSTRACT

The present invention is a valve control device (10) for an internal combustion engine (12). It comprises a housing (18) having a piston chamber (20), in which is mounted a power piston (22) for reciprocating movement. The power piston (22) is connected to the engine valve (26). An air reservoir chamber (62) connected to a high pressure air source (74), is formed above the piston chamber (20). A poppet valve (42) mounted on the upper surface of the power piston (22) blocks communication between the piston chamber (20) and the air reservoir chamber (62) when the power piston (22) is in its highest position. The air source (74) is also connectred to the upper portion of the piston chamber (20) through a timing valve (76), which controls flow of air to the piston chamber (20).

15 Claims, 2 Drawing Sheets

INTERNAL COMBUSTION ENGINE VALVE CONTROL DEVICE

TECHNICAL FIELD OF THE INVENTION

This invention relates generally to internal combustion engines. More particularly, but not by way of limitation, this invention relates to a valve control device for use in an internal combustion engine for controlling engine intake and exhaust valve timing and duration.

BACKGROUND OF THE INVENTION

The fuel efficiency and power output of an internal combustion engine can be significantly improved by optimizing the intake and exhaust valve timing and duration as the engine speed changes during operation. Valve timing refers to the angular position of the engine crank shaft the moment the valve is opened. Valve duration refers to the length of time the valve remains in an open position.

A number of devices are conventionally used in engines to open and close intake and exhaust valves. These devices include cam shafts, push rods, rocker arms and hydraulic tappets. These devices do not permit variation of either valve timing or duration during engine operation and are expensive and subject to failure. In addition, their use results in substantial energy loss due to friction.

Consequently, a need exists for a device that permits variable valve timing and variable valve duration during transient engine operation and eliminates conventional valve operation gear.

Two patents issued to Richeson, U.S. Pat. No. 4,899,700 and U.S. Pat. No. 4,915,015, disclose an electronically controlled pneumatically powered valve mechanism actuator for use in an internal combustion engine.

U.S. Pat. No. 885,459 issued to Engler et al. discloses a pneumatic or hydraulic engine valve control mechanism.

SUMMARY OF THE INVENTION

This invention provides, in an internal combustion engine, a valve control mechanism that permits variable intake or exhaust valve timing and duration during engine operation without conventional valve operation gear.

In one aspect of the invention, the engine valve is connected to a power piston, which is mounted in a power piston chamber formed in a housing. The engine valve is biased toward a closed position. A second smaller chamber in communication with a high pressure air source is formed above the power piston chamber. The power piston chamber is also in communication with the high pressure air source through a timing valve. When the engine valve is in a closed position, a poppet valve formed on the upper surface of the power piston blocks communication between the second chamber and the power piston chamber. To open the engine valve, the timing valve is opened. This allows high pressured air to move from the air source to the power piston chamber, forcing the power piston to move slightly downward and opening the poppet valve on the power piston. When the poppet valve is opened, high pressured air from the second chamber moves into the power piston chamber and rapidly drives the power piston and the engine valve downward to an open position.

In another aspect of the invention, the engine valve duration is controlled by a bleed valve that is connected to a second bore. Positioned in the second bore is a second piston, which is connected to the power piston so that the two pistons move simultaneously. When the power piston moves downward to open the engine valve, the hydraulic piston follows and, in the process, draws oil into the second bore. The second piston and the engine valve then begin to move upward as a result of the upward force exerted by the biasing spring. The rate at which they move is controlled by how rapidly oil can flow out of the bleed valve. If the bleed valve is wide open, the second piston moves quickly and if the bleed valve is nearly closed, the second piston moves slowly. When the second piston reaches a certain predetermined point in the second chamber, oil in the chamber is quickly released, allowing proper closing of the engine valve.

BRIEF DESCRIPTION OF THE DRAWINGS

The foregoing and additional objects and advantages of the invention will become more apparent as the following detailed description is read in conjunction with the accompanying drawings wherein like reference characters denote like parts in all views and wherein.

DETAILED DESCRIPTION OF THE PREFERRED EMBODIMENT

Figure 1:
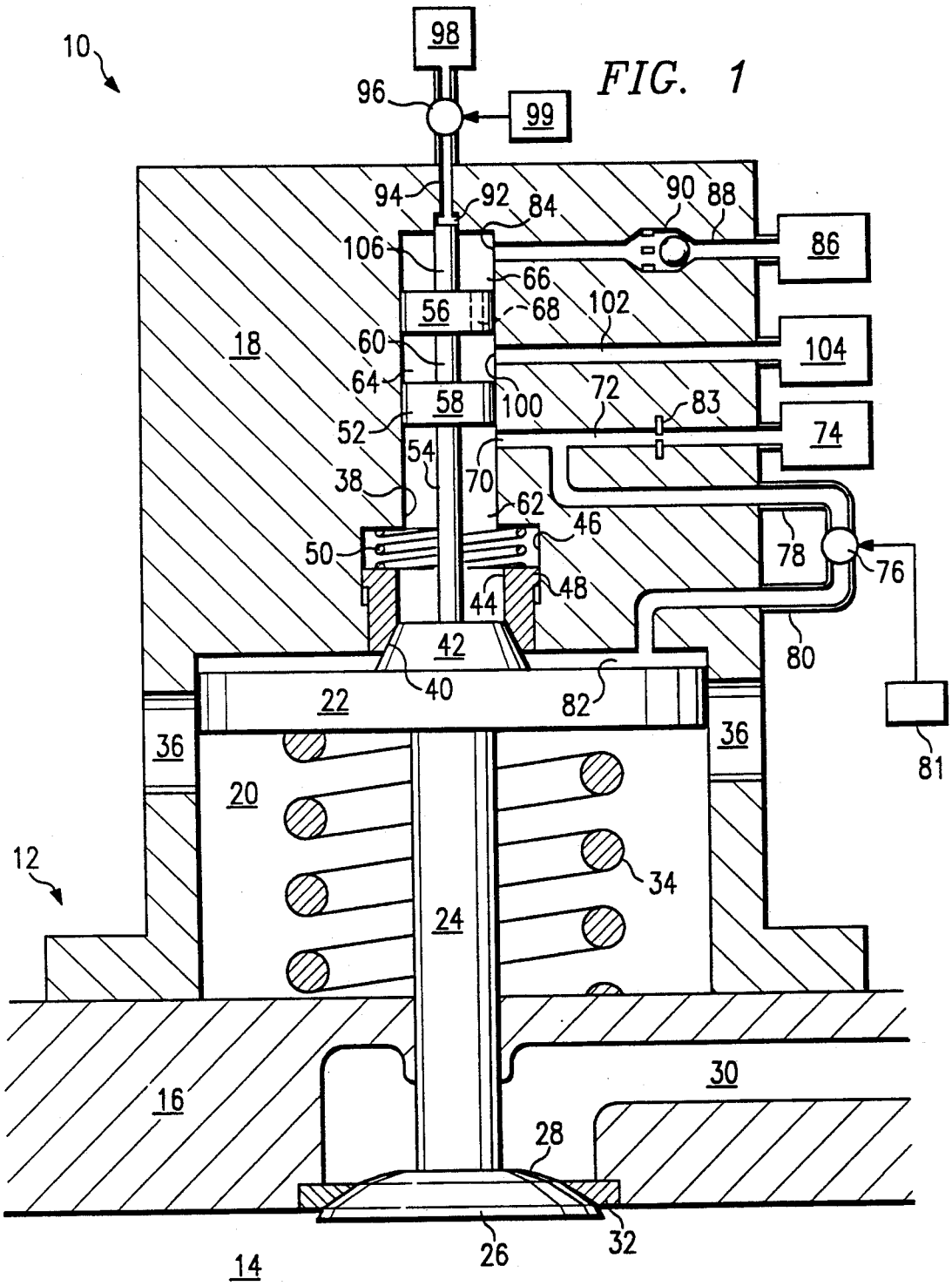
FIG. 1 is a fragmentary, partly schematic cross-sectional view showing the valve control device in an internal combustion engine constructed in accordance with the invention with the engine valve in a closed position.

FIG. 1 is a cross-sectional view of a valve control device generally designated by reference character 10 that is constructed in accordance with the invention. The valve control device 10 is mounted in a partly shown internal combustion engine generally designated by reference character 12. The engine 12 includes a cylinder block (not shown) having at least one cylinder bore 14 extending through the cylinder block. A cylinder head 16 closes the upper end of the cylinder bore 14. Mounted on the cylinder head 16 is the valve control device 10.

The valve control device 10 includes a housing 18. A first bore partially extending into the lower portion of the housing 18 forms a power piston chamber 20. A power piston 22 is located in the power piston chamber 20 for reciprocating movement therein. The underside of the power piston 22 is secured to a valve stem 24, which extends through the cylinder head 16 to connect with an engine intake or exhaust valve 26. The valve 26 opens and closes as the power piston 22 reciprocates within the power piston chamber 20.

An engine valve port 28 for engaging the engine valve 26 is formed in the lower side of the cylinder head 16 and is connected to an intake or exhaust duct 30. The duct 30 is formed, partially in the cylinder head 16, to communicate with the cylinder bore 14 through the engine valve port 28. An annular engine valve seat 32 encircles the valve port 28 for engaging the valve 26 to provide proper closing. Thus, the opening and closing of the engine valve 26 permits and prevents communication respectively between the duct 30 and the cylinder bore 14.

The engine valve 26 is biased upward toward a closed position by a valve biasing spring 34 that is positioned inside the power piston chamber 20 beneath the power piston 22. Blowdown or pressure relief ports 36 are formed in the housing 18 to allow communication between the power piston chamber 20 and the atmosphere or any space outside the housing 18. The blowdown ports 36 are formed at a position in the housing 18 such that when the power piston 22 is at it highest position, the power piston 22 covers or is above the blowdown ports 36 and when the power piston 22 is at its lowest position, it at least partially uncovers the blowdown ports 36 and allows communication between the chamber 20 and the atmosphere to reduce the pressure in the chamber 20 above the piston 22.

A second housing bore 38 having a diameter smaller than the power piston chamber 20 is formed in the housing 18 above the chamber 20. The lower end of the second housing bore 38 comprises a port 40 for communication between the power piston chamber 20 and second housing bore 38. A poppet valve 42 is mounted on the upper surface of the power piston 22. A poppet valve seat 44 corresponding to the poppet valve 42 is positioned at the port 40. The poppet valve 42 engages the seat 44 to permit and prevent communication between the power piston chamber 20 and the second housing bore 38 as the power piston 22 reciprocates in the chamber 20.

The poppet valve seat 44 is positioned at the port 40 for reciprocating movement. The lower portion of the second bore 38 contains a widened portion 46. The poppet valve seat 44 comprises an upper flange portion 48, which is located in the widened portion 46. Also mounted in the widened portion 46, above the upper flange portion 48, is a valve seat spring 50, which biases the poppet valve seat 44 downward toward the poppet valve 42. The spring-loading of the valve seat 44 allows both the poppet valve 42 and the engine valve 26 to be simultaneously and securely seated on valve seats 44 and 32, respectively. The seating of the valves 42 and 44 is secure even if the length of the valve stem 24 changes as a result of thermal expansion or contraction or the distance between seats 44 and 32 changes as a result of thermal expansion or contraction or wear.

The second bore 38 forms a chamber for a second piston 52 that is mounted therein for reciprocating movement. The second piston 52 is mounted on a second piston stem 54, which is in axial alignment with the engine valve stem 24 and is secured to the poppet valve 42 mounted on the power piston 22. Thus, the power piston 22 and the second piston 52 move simultaneously.

The second piston 52 consists of two portions, an upper piston portion 56 and a lower piston portion 58 connected by member 60. The two piston portions define three distinct chambers in the second bore 38, a lower chamber or an air reservoir chamber 62, a middle chamber 64 and an upper chamber 66. A piston passage 68 is formed in the upper piston portion 56 of the second piston 52 to allow restricted fluid flow between the upper chamber 66 and the middle chamber 64.

When the engine valve 26 is in a closed position as shown in FIG. 1, an air reservoir port 70 formed in the air reservoir chamber 62 is uncovered by the lower piston portion 58. The port 70 is in communication with one end of an air supply passage 72. The other end of the air supply passage 72 is connected to an air supply means 74, which supplies high pressured air to the air reservoir 62. The air supply passage 72 is also in communication with a small electrically operated timing valve 76 through a second air passage 78. The timing valve 76, in turn, is in communication with the upper portion of the power piston chamber 20 through a third air passage 80. As FIG. 1 shows, when the power piston 22 is at its highest position, a narrow space 82 exists between the upper surface of the power piston 22 and the upper portion of the power piston chamber 20. The timing valve 76 controls air flow to the space 82.

The timing valve 76 is electrically connected to a computer or an electronic control device 81 , which provides signals to and controls the operation of the timing valve 76.

An orifice 83 is located in air supply passage 72 near the air supply means 74 to regulate air flow from the supply means 74.

The upper chamber 66 has a first port 84 formed therein for communication with an oil supply means 86 through a first oil passage 88. The oil supply means 86 preferably comprises an engine oil pump (not shown) that is used to supply lubricating oil to the engine. The first oil passage 88 contains a check valve 90, which allows oil to flow only from the oil supply means 86 to the upper chamber 66.

An opening 92 is formed in the upper chamber 66 to allow communication with a second oil passage 94 leading to a bleed valve 96. The bleed valve 96 regulates the flow of oil out of the upper chamber 66 to an oil reservoir 98.

The bleed valve 96 like the timing valve 76 is electrically connected to a computer or an electronic control device 99, which provides signals to and controls the cooperation of the bleed valve 96. The electronic control devices 81 and 99 may have their respective functions incorporated in a single control device.

Figure 2:
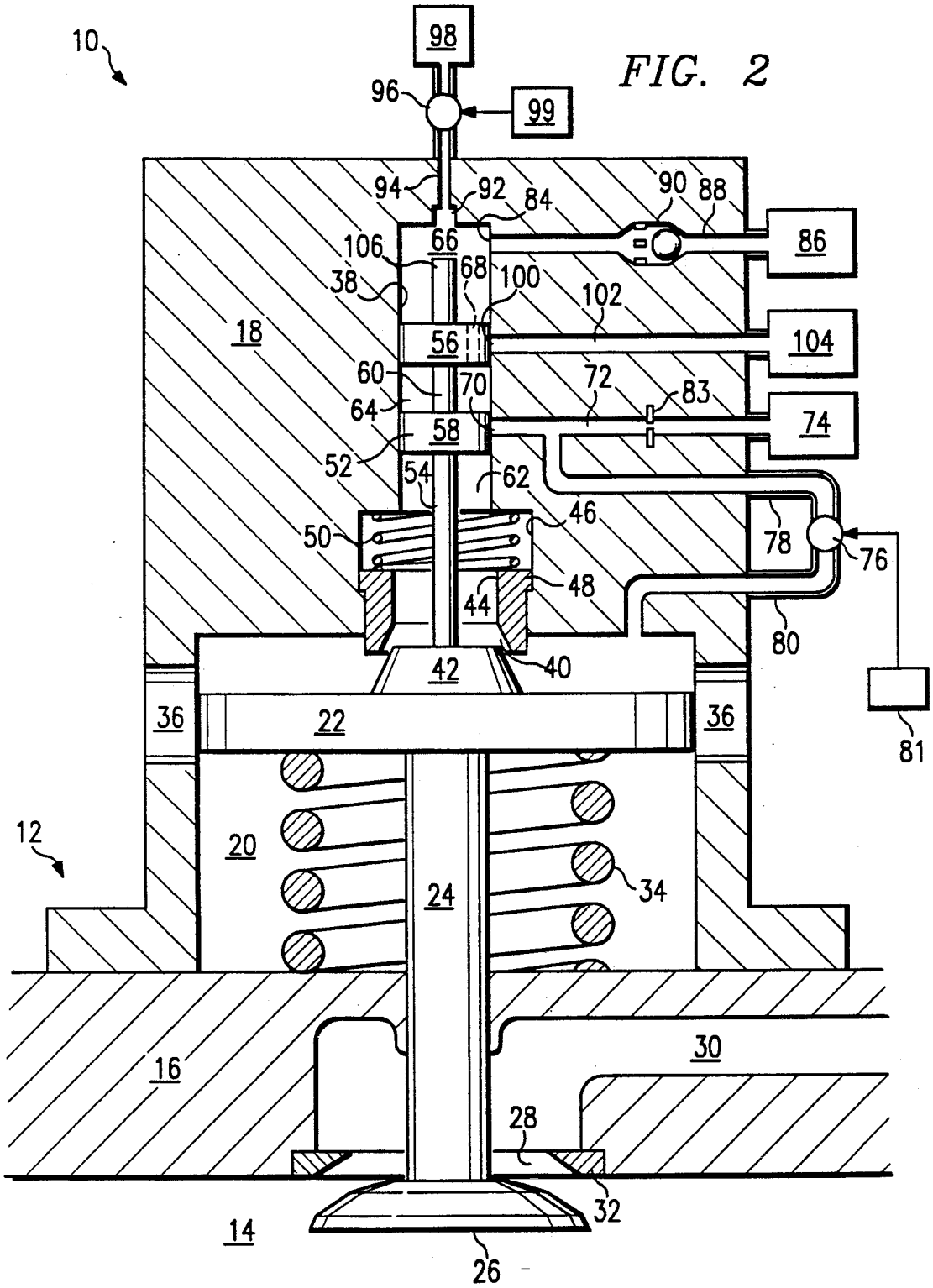
FIG. 2 shows the valve control device of FIG. 1 with the engine valve in an opened position.

A middle chamber port 100 is formed in the middle chamber 64. The port 100 is connected to a third oil passage 102 leading to an oil reservoir 104. Oil reservoirs 98 and 104 may be connected to each other and to oil supply means 86. When the engine valve 26 is in a closed position as shown in FIG. 1, the port 100 is not covered by the second piston 52. However, when the engine valve 26 is in an open position as shown in FIG. 2, the port 100 is covered by the upper piston portion 56.

A snubber 106 is located on the upper surface of the upper piston portion 56 in alignment with the opening 92. The opening 92 accommodates the snubber 106 by being wider than the snubber 106, which enters the opening 92 as the engine valve 26 moves upward toward the closed position. The snubber 106 engages hydraulic fluid in the opening 92, effectively slowing the second piston 52 as it moves to its highest position, preventing heavy impacts by reducing the closing speed of the engine valve 26.

While it is preferred that air be used as the substance to apply force to and cause movement of the power piston, other gases or expandable fluids may be suitable. Similarly, while it is preferred that oil is the substance used in controlling valve duration, other liquids may also be suitable.

OPERATION OF THE PREFERRED EMBODIMENT

FIG. 1 shows the engine valve 26 in a closed position. When in this position, the air supply means 74 is in communication with the air reservoir 62. Consequently, the air within the air reservoir 62 is at a high pressure relative to the pressure in the space 82 above the power piston 22. To initiate the opening of the engine valve 26, the electronic control device 81 activates the timing valve 76 to open, which forces air at high pressure to the space 82 above the power piston 22. The high pressure applied to the piston 22 causes it to move downward slightly against the force of the spring 34, dislodging the poppet valve 42 from the poppet valve seat 44. The air reservoir 62 consequently comes in communication with the power piston chamber 20. The high pressure air in the air reservoir 62 moves quickly into the power piston chamber 20, where it is applied to a larger surface area of the piston 22. As a result, greater force is applied to the piston 22, causing it to be driven downward. The engine valve 26 moves to the open position shown in FIG. 2.

As the power piston 22 moves downward, so does the second piston 52. The downward movement of the second piston 52 causes oil to be drawn from the oil supply means 86 into the upper oil chamber 66. When the engine valve 26 is in the open position shown in FIG. 2, the upper portion 56 of the second piston 52 covers the middle chamber port 100 leading to the oil reservoir 104.

In addition, the lower portion 58 of the second piston 52 covers the air supply port 70. The power piston 22, in the position shown in FIG. 2 uncovers the blowdown ports 36. The high pressured air above the power piston 22 escapes through the ports 36 to the atmosphere. When this occurs, the upward force exerted by the valve biasing spring 34 on the power piston 22 exceeds any downward force from the air reservoir 62 and allows the power piston 22 to move upward carrying the engine valve 26 toward the closed position shown in FIG. 1.

The engine valve duration or the period of time that the engine valve 26 remains open is determined by how quickly oil that is in the upper chamber 66 can be forced out through the bleed valve 96. As previously noted and as shown in FIG. 2, the middle chamber port 100 leading to the oil reservoir 104 is covered by the upper portion 56 of the second piston 52. Thus, oil from the upper oil chamber 66 can not escape through the piston passage 68 and out of the port 100. In addition, the check valve 90 prevents oil from flowing out of the port 84. Consequently, oil can only flow out of the upper chamber 66 through the bleed valve 96.

The electronic control device 99 controls the degree of the opening of the bleed valve 96. If the bleed valve 96 is nearly closed, the second piston 52 and the engine valve 26 move upward slowly as oil moves slowly through the bleed valve 96. On the other hand, if the bleed valve 96 is wide open, the second piston 52 and the engine valve 26 move upward quickly. In either case, as the upper piston portion 56 of the second piston 52 moves upward to a particular point in the second bore 38, it uncovers the middle chamber port 100 leading to the oil reservoir 104. This causes oil in the upper chamber 66 that has not escaped through the bleed valve 96 to move through the piston passage 68 and into the middle chamber port 100 leading to the oil reservoir 104, allowing the engine valve 26 to properly close. As previously described, the snubber 66 engages the opening 92 just before complete closing, preventing heavy closing impacts. The valve control device is now in a position to begin another open-close cycle.

Thus, valve timing for the engine 12 is controlled by the small electrically operated timing valve 76 and valve duration is controlled by the bleed valve 96. Both valve timing and duration can be varied as the engine 12 is operated. A significant advantage of this invention is that it permits rapid opening of the engine valve 26 and careful control of the duration of the opening. Furthermore, no conventional valve operation gear like camshafts, push rods, rocker arms and hydraulic tappets, all of which are expensive, subject to impact failure and have substantial energy loss due to friction, are required.

Although the present invention has been described with respect to specific, preferred embodiments thereof, various changes and modifications may be suggested to one skilled in the art, and it is intended that the present invention encompasses such changes and modifications as fall within the scope of the appended claims.

What is claimed is:

1. Valve control apparatus for use in an internal combustion engine for controlling intake and exhaust engine valves having valve stems, the apparatus comprising:
   - a housing having a multiple diameter bore extending therethrough;
   - a power piston mounted in a lower end of said bore for reciprocating movement therein, the lower surface of said power piston secured to one of the valve stems;
   - means biasing the engine valve toward a closed position;
   - a poppet valve portion formed on the upper surface of said power piston for engaging said housing encircling said bore to permit and prevent communication through said bore when said power piston is at its highest position;
   - first pressurized fluid supply means in communication with and providing a first fluid to said bore relatively above said poppet valve portion; and
   - a timing valve for controlling flow from said first pressurized fluid supply means and to said bore relatively below a part of said poppet valve portion and above said power piston for rapidly opening said engine valve.

2. The apparatus of claim 1, wherein said first fluid comprises air.

3. The apparatus of claim 2 and also including a poppet valve seat encircling said bore and engagable with said poppet valve portion.

4. The apparatus of claim 3, wherein said poppet valve seat is reciprocatingly moveable and said apparatus further includes a seat spring positioned above said poppet valve seat to bias said poppet valve seat toward said poppet valve portion.

5. The apparatus of claim 2, and further including a blowdown port formed in said lower end of said housing to allow communication between said bore and the exterior of said housing, said blowdown port formed at a position in said housing such that when said power piston is at its highest position, said blowdown port is below said upper surface of said power piston and when said power piston is at its lowest position, said power piston at least partially uncovers said blowdown port.

6. The apparatus of claim 2, wherein said biasing means comprise a valve spring mounted in said bore under said power piston.

7. The apparatus of claim 2, and further including a second piston in said bore above said power piston moveable therein for preventing and permitting flow between said first fluid supply means and said bore relatively above said poppet valve portion.

8. The apparatus of claim 2 and also including:

a second piston mounted in said bore for reciprocating movement above said power piston, said second piston connected to said power piston; and a port formed in said bore for allowing communication between said first fluid supply means and said bore relatively above said poppet valve portion.

9. The apparatus of claim 1, wherein said bore comprises an upper bore portion and a lower bore portion that is wider than said upper bore portion, said power piston mounted in said lower bore portion, the apparatus further including:

a second piston connected to said poppet valve portion and located in said upper bore portion for reciprocating movement therein, said second piston separating said upper bore portion into an upper chamber and a lower chamber such that only said lower chamber may communicate with said first fluid supply means;

second pressurized fluid supply means communicating with said upper chamber for providing a second fluid to said upper chamber; and a bleed valve communicating with said upper chamber for regulating flow of said second fluid out of said upper chamber.

10. The apparatus of claim 9, wherein said first fluid comprises air and said second fluid comprises hydraulic fluid.

11. The apparatus of claim 10 further including:

a snubber secured to the upper surface of said second piston; and an opening in communication with the bleed valve for engaging said snubber to reduce heavy closing impacts.

12. The apparatus of claim 10, wherein said second fluid supply means communicates with said upper chamber through a fluid supply passage and further including a check valve in said fluid supply passage to allow flow of hydraulic fluid only from said second fluid supply means to said upper chamber.

13. The apparatus of claim 9, wherein said second piston comprises an upper piston portion and a lower piston portion connected by a second connecting member and defining a middle chamber therebetween, the apparatus further including:

a piston passage formed in said upper piston portion to allow communication between said upper chamber and said middle chamber; and an oil dump port formed in said middle chamber to allow oil to move out of said middle chamber, said oil dump port covered by said upper piston portion when the engine valve is in an open position and uncovered by said upper piston portion when the engine valve is in a closed position.

14. A method of opening an internal combustion engine intake or exhaust valve biased toward a closed position, the valve being connected by a valve stem to the underside of a power piston, the method comprising the steps of:

applying high pressure air to only one portion of the upper surface of the piston, the high pressure air insufficient to cause movement of the piston; and applying the high pressure air to an additional area of the upper surface of the piston forcing the piston downward and thereby moving the engine valve to an open position.

15. A method of opening and closing an internal combustion engine intake or exhaust valve biased toward a closed position by a biasing spring, the valve being connected by a valve stem to the underside of a power piston, the method comprising the steps of:

applying a high pressure air source to only one portion of the upper surface of the piston, the high pressure air source insufficient to cause movement of the piston;

applying the high pressure air source to an additional area of the upper surface of the piston forcing the piston downward and moving the engine valve to an open position;

supplying a fluid into a chamber above the piston;

reducing the pressure applied to the upper surface of the power piston, thereby allowing the power piston to be moved upward by the force applied by the biasing spring and pushing the fluid out of the chamber through a bleed valve;

regulating the flow of the fluid out of the chamber by adjusting the opening of the bleed valve, thereby controlling the upward speed of the power piston; and releasing all fluid from the chamber rapidly once the power piston has moved a predetermined distance, causing the engine valve to close.

* * * * *